United States Patent [19]

Maxel

[11] 4,061,817

[45] Dec. 6, 1977

[54] LUGGAGE SHELLS AND PROCESS FOR THE MANUFACTURE THEREOF

[75] Inventor: John M. Maxel, St. Charles, Ill.

[73] Assignee: Armco Steel Corporation, Middleton, Ohio

[21] Appl. No.: 591,493

[22] Filed: June 30, 1975

Related U.S. Application Data

[63] Continuation of Ser. No. 483,793, June 27, 1974, abandoned.

[51] Int. Cl.[2] ..... A45C 13/38

[52] U.S. Cl. ..... 428/246; 156/245; 190/53; 428/273; 428/337; 428/339

[58] Field of Search ..... 156/245; 428/210, 236, 428/241, 251, 228, 260, 261, 268, 220, 174, 325, 441, 375, 404, 246, 339; 264/136, 137, DIG. 53; 190/53

[56] References Cited

U.S. PATENT DOCUMENTS

| | | | |
|---|---|---|---|
| 3,113,788 | 12/1963 | Johnston | 428/132 |
| 3,383,272 | 5/1968 | Gluck | 428/300 |
| 3,416,990 | 12/1968 | Robinson | 428/441 |
| 3,544,418 | 12/1970 | Holtzman | 156/306 |
| 3,578,544 | 5/1971 | Thorsrud | 428/317 |
| 3,684,645 | 8/1972 | Temple et al. | 428/222 |
| 3,723,234 | 3/1973 | MacDonald | 156/293 |
| 3,850,723 | 11/1974 | Ackley | 264/136 |

*Primary Examiner*—James J. Bell
*Attorney, Agent, or Firm*—Richard L. Johnston

[57] ABSTRACT

Light weight strong three dimensional luggage shells are produced by heating a glass fiber reinforced thermoplastic sheet containing 5% to 50% by weight glass fibers, and stamping the resultant expanded sheet while still hot between matched male and female cold dies.

5 Claims, 8 Drawing Figures

LUGGAGE SHELLS AND PROCESS FOR THE MANUFACTURE THEREOF

This is a continuation of application Ser. No. 483,793, filed June 27, 1974, now abandoned.

BACKGROUND

In recent years most hardsided luggage has been produced from cellulose products requiring extensive equipment and operations. One such type of luggage is made from cellulose fibers reinforced with cut glass fiber rovings to form a shell having the desired luggage shape which is then covered with a covering of a vinyl plastic sheet or other suitable material in a separate operation. Molded luggage has also been formed by vacuum forming methods from various types of thermoplastic sheet materials.

OBJECTS

One of the objects of the present invention is to provide a new and improved process for forming luggage shells for hardsided luggage by a simple operation which eliminates the extensive equipment processing and labor required by previous processes in which luggage shells have been made from cellulose products reinforced with glass fibers and which produces a product having greater impact resistance for equivalent weight when compared with luggage produced by vacuum forming thermoplastic sheets.

Another object of the invention is to provide a process of the type described in which a covering of vinyl plastic sheet backed material or other suitable sheet material can be applied to a luggage shell simultaneously with the formatin of the luggage shell.

Other objects and advantages of the invention will appear from the following description in conjunction with the accompanying drawing in which various figures illustrate diagrammatically the steps in the process.

THE DRAWING

Figure 2:
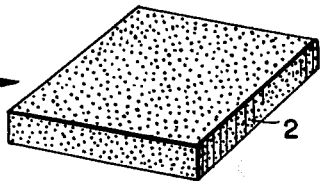
FIG. 2 illustrates the sheet shown in FIG. 1 after it has been heated.
Figure 6:
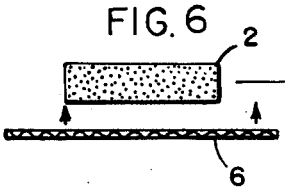
Figure 7:
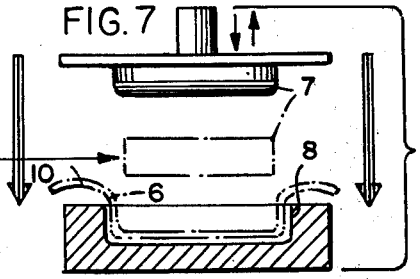
Figure 8:
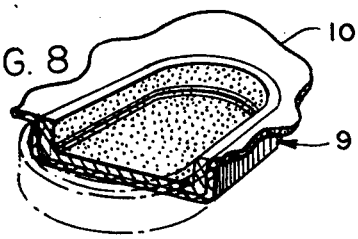

FIGS. 6 and 7 illustrate a modification of the invention in which a thermoplastic vinyl sheet with a backing, or other compatible covering, is draped across a female die, the heated sheet of FIG. 2 is placed over the covering and the combination of the sheet of FIG. 2 and the covering is stamped under sufficient pressure to cause the cross section to be reduced and simultaneously to form a three dimensional shell of a type suitable for use as a luggage shell wherein a covering is applied to the outer surface of the shell simultaneously with the formation of the shell; and FIG. 8 is a perspective view, partly in section, illustrating a luggage shell as it comes from the dies in FIG. 7.

BRIEF SUMMARY OF THE INVENTION

In accordance with the invention a process is provided for producing three dimensional luggage shells by heating a glass fiber reinforced thermoplastic sheet containing 5% to 50% by weight glass fibers, and stamping the resultant sheet while still hot between matched male and female cold dies under superatmospheric pressure sufficient to cause the cross section to be reduced to a thickness less than the cross section of the original glass fiber reinforced thermoplastic sheet.

In a modification of the process, a backed vinyl sheet or other suitable covering which is compatible with the glass fiber reinforced thermoplastic sheet is applied either to one or both sides of the glass fiber reinforced thermoplastic sheet and simultaneously stamped with the glass fiber reinforced thermoplastic sheet to form a three dimensional luggage shell having the outside or inside, or both, covered with a vinyl covering or other suitable type of covering.

DETAILED DESCRIPTION OF THE INVENTION

Figure 1:
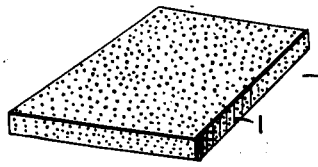
FIG. 1 is a perspective view of a glass fiber reinforced thermoplastic sheet employed as a starting material in the process.
Figure 3:
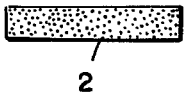
FIGS. 3 and 4 illustrate the positioning of the hot thermoplastic sheet containing the glass fibers between matched male and female cold dies.
Figure 4:
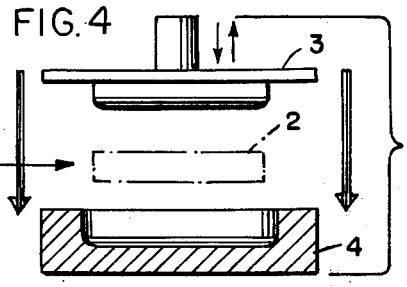

The process is preferably carried out by using as a starting material a glass fiber reinforced thermoplastic sheet containing 5% to 50% by weight glass fibers. A preferred sheet of this type as illustrated by the feed stock 1 in FIG. 1, is a polypropylene sheet which contains about 42% by weight glass fibers and is approximately 0.150 inch thick. This sheet is first heated very rapidly in an oven to a temperature of about 400° F. to give an expanded feed stock material 2 as shown in FIG. 2 which is fed into a stamping press as shown in FIGS. 3 and 4.

The stamping press contains matched metal male and female dies 3 and 4 which are water cooled. The press is closed and stops at the bottom of its stroke.

Figure 5:
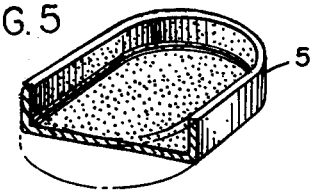
FIG. 5 is a perspective view, partly in section, illustrating a molded article obtained by stamping the thermoplastic sheet between two matched male and female cold dies as shown in FIG. 4.

When heated, the glass fiber reinforced polypropylene feed stock 1 expands to about twice its initial thickness. This expanded material 2 is placed in the female mold and is stamped rapidly so as to cause the material to flow and fill the mold. The actual stamping takes place in a fraction of a second with a total over-all cycle of 15 to 30 seconds. The dies are then separated and the molded shell 5, as shown in FIG. 5, which now has its cross section reduced to a thickness less than the cross section of the original glass fiber reinforced polypropylene feed stock 1, is removed from the dies. In a typical operation the initial glass fiber reinforced polypropylene feed stock 1 will have a thickness of about 0.08 inch to 0.15 inch and the finished product preferably has a thickness of around 0.04 to 0.06 inch.

If desired, a vinyl covering 6 with a fabric or non-woven backing can be placed in the female mold and simultaneously applied and bonded through the backing to the heated expanded glass fiber reinforced polypropylene feed stock 2 when the piece is formed by stamping it between male die 7 and female die 8 as shown in FIG. 7 to produce a covered shell 9 as shown in FIG. 8 A vinyl covering with a backing of woven fabric or non-woven fibers (e.g., cotton or other cellulose fibers or other fibers compatible with the thermoplastic polymer, is used because most thermoplastic resins (in the feed stock) will not bond directly to a vinyl (e.g., polyvinyl chloride) sheet. Instead of a vinyl covering other types of coverings can be applied in a similar way, for example, by using woven fabrics made from cotton, silk or other natural or synthetic fibers. The covering can also be applied in a similar manner to the inside of the molded shell. Alternatively, a covering can be applied to the molded shell after it has been removed from the dies. The portions 10 which extend beyond the edges of the covered shell are trimmed by cutting them in any suitable manner.

A typical molded shell produced in the manner described without the covering will have a specific gravity around 0.90 to 1.40.

Other types of glass fiber reinforced thermoplastic sheet stock which have properties similar to polypropylene can be employed in the same way to produce a glass fiber reinforced thermoplastic luggage shell having greater impact resistance than luggage shells formed by vacuum forming from ABS (acrylonitrile-butadiene-styrene) resins with equivalent weight. For example, shell stock made from acrylonitrile-butadiene-styrene copolymers, polyethylene, polycarbonates, or other thermoplastic polymers and copolymers containing 5% to 50% glass fibers can be used.

The glass fibers are preferably cut bundles of glass rovings (a commercially available material contains 60 strands of glass filaments with 204 filaments per strand) cut in lengths from ¼ inch to 3 inches, usually about 1 inch, but they can be longer than 3 inches. Alternatively, the feed stock can be composed of continuous glass filaments distributed in the thermoplastic resinous material and can be produced by the process disclosed in U.S. Pat. No. 3,713,962.

The invention is especially advantageous in making it possible to produce luggage shells with high impact resistance by a very simple process and to produce luggage shells containing various types of coverings by a process in which the shell is formed and the covering is applied simultaneously as distinguished from typical commercial processes heretofore employed where the covering has to be applied separately after the shell has been formed.

In the example given, the superatmospheric pressure used can be supplied by a 400 ton mechanical or hydraulic stamping or forming press, but other types of presses can be employed. In general, the pressure applied in the press will depend upon the configuration and complexity of the part to be formed.

Luggage shells made in accordance with the invention are not only light in weight but also quite strong with flexural strengths within the range of 5,000 to 30,000 pounds per square inch and notched Izod impact resistances of 2 to 15 foot pounds per inch.

It will also be understood that the temperature to which the glass fiber reinforced thermoplastic sheet stock is heated, while preferably about 400° F. for a glass fiber reinforced polypropylene sheet stock, may be different for other thermoplastic sheet stocks reinforced with glass fibers but should be such that the sheet stock will flow and fill the mold when stamped between cold dies (e.g., dies cooled to temperatures of 40° to 80 ° F.). One or more plies or layers of sheet stock can be used.

The invention is hereby claimed as follows:

1. An article of luggage including in combination a molded three-dimensional self-supporting luggage shell consisting essentially of a glass fiber reinforced thermoplastic polymer sheet containing 5% to 50% by weight glass fibers distributed therein, said shell being covered with a sheet material, said shell having a thickness of approximately 0.04 to 0.06 inch as compressed from an initial sheet stock thickness of about 0.08 to 0.15 inch and said shell having a specific gravity throughout within the range of 0.90 to 1.40, said shell as compressed having a flexural strength within the range of 5,000 to 30,000 pounds per square inch and a notched izod impact resistance within the range of 2 to 15 foot pounds per inch.

2. An article of luggage as claimed in claim 1 in which said thermoplastic polymer is selected from the group consisting of polyethylene, polypropylene, acrylonitrile-butadiene-styrene and polycarbonates.

3. An article of luggage as claimed in claim 1 in which said thermoplastic polymer is polypropylene.

4. An article of luggage as claimed in claim 1 in which said sheet material is a vinyl covering.

5. An article of luggage as claimed in claim 4 in which said vinyl covering has a backing of woven or nonwoven fibers compatible with said thermoplastic polymer.

* * * * *